US005744744A

United States Patent [19]

Wakuda

[11] Patent Number: 5,744,744

[45] Date of Patent: Apr. 28, 1998

[54] ELECTRIC STRINGED INSTRUMENT HAVING AUTOMATED ACCOMPANIMENT SYSTEM

[75] Inventor: Sadamoto Wakuda, Shizuoka-ken, Japan

[73] Assignee: Kabushiki Kaisha Kawai Gakki Seisakusho, Shizuoka-Ken, Japan

[21] Appl. No.: 327,629

[22] Filed: Oct. 24, 1994

[30] Foreign Application Priority Data

Oct. 28, 1993 [JP] Japan ..... 5-270939
Oct. 28, 1993 [JP] Japan ..... 5-270940

[51] Int. Cl.[6] ..... G10H 1/36; G10H 1/46

[52] U.S. Cl. ..... 84/650; 84/610; 84/634; 84/633; 84/666; 84/711; 84/712; 84/727; 84/728

[58] Field of Search ..... 84/610, 611, 612, 84/614, 633, 634, 635, 636, 637, 638, 650, 651, 652, 666, 667, 668, 669, 665, 712–717, 711, 741, 602, 609, 723, 726–728, 731, 735, 737–738

[56] References Cited

U.S. PATENT DOCUMENTS 3,986,426 10/1976 Faulhaber ..... 84/1.23
4,387,621 6/1983 Franzmann ..... 84/1.16
4,713,996 12/1987 Oguri ..... 84/1.03
5,133,015 7/1992 Scholz ..... 381/61
5,194,682 3/1993 Okamura et al. ..... 84/625
5,223,659 6/1993 Shiraki et al. ..... 84/669
5,308,916 5/1994 Murata et al. ..... 84/603

*Primary Examiner*—William M. Shoop
*Assistant Examiner*—Marlon T. Fletcher
*Attorney, Agent, or Firm*—Davis and Bujold

[57] ABSTRACT

An electric stringed instrument having an integral accompaniment system is proposed. The vibrations of the strings on the electric stringed instrument are detected as analog signals by a pickup device. A portion of the detected signal is extracted, has its voltage adjusted, is converted into a digital signal, and is read into a CPU as a digital signal within a range of 0–5 volts. An amplification factor of the digital signal is determined according to sound volume data included in accompaniment data stored within the accompaniment system, and the proportion of sound volume between the player's performance and an automatically generated accompaniment is adjusted by multiplying the sound volume of the player's performance, or of the accompaniment, by the amplification factor. The sound volume adjustment is effected only once and only when an automatic balancing switch provided on the instrument is depressed.

8 Claims, 8 Drawing Sheets

ELECTRIC STRINGED INSTRUMENT HAVING AUTOMATED ACCOMPANIMENT SYSTEM

FIELD OF THE INVENTION

This invention relates to an electric stringed instrument provided with an automated accompaniment system. More specifically, this invention relates to an electric guitar, electric bass and other electric stringed instruments integrally provided with an automated accompaniment system, to facilitate a satisfying performance simulating band-play for a lone player.

BACKGROUND OF THE INVENTION

When a lone electric guitar player wishes to simulate play in a band or full orchestra, he has to prepare a rhythm box storing accompaniment patterns and a mixing apparatus. He then connects his guitar and the rhythm box to the mixing apparatus. Musical signals created by his guitar and the rhythm box are mixed by the mixing apparatus, amplified and outputted as sound from the speakers. Alternatively, he plays against an accompaniment played by existing audio equipment, with his guitar connected to an amplifier and speakers which are for exclusive use by the electric guitar.

Thus, when simulating a band play, the lone player has to connect a rhythm box and mixing apparatus or prepare audio equipment. Although an electronic musical instrument is known which is in the shape of a guitar and does not require additional equipment, such an electronic instrument lacks in affluence of timbre created by various techniques, such as vibrato, choking and harmonics, that is unique to an electric guitar.

Further, the player who chooses to use a rhythm box must adjust the balance of sound volume between his electric guitar and the rhythm box. Otherwise, the player has to endure unadjusted sound volume of the electric guitar and the rhythm box, which is likely to be off balance and unpleasant to hear. Volume adjustment switches are provided separately on the electric guitar and rhythm box and are therefore laborious to manipulate. Worse still, balance of sound volume cannot be anticipated until the player actually lets out the sound.

SUMMARY OF THE INVENTION

Wherefore, an object of the present invention is to provide an automated accompaniment system which automatically adjusts the balance of the sound volume, thereby freeing the player from laborious manual adjustments of the sound volume. A further object is to provide an automated accompaniment system that creates sound rich in timbre. Such advantages are provided for electric guitars and other electric stringed instruments according to the present invention.

In order to attain the stated object, a musical accompaniment system of the present invention includes:

play signal output means for detecting a musical performance created by a player or singer and for outputting a play signal according to the detected musical performance;

accompaniment signal output means for outputting an accompaniment signal against the musical performance created by a player or singer;

mixing means for mixing the play signal and accompaniment signal;

amplifier means for amplifying the play signal and accompaniment signal before or after they are mixed; and a speaker for emitting sound according to the mixed and amplified signal, the accompaniment system further comprising:

volume proportion determination means for determining whether or not the sound volumes of the play signal and accompaniment signal are in a predetermined proportion; and volume adjustment means for relatively adjusting the sound volume of the play signal and accompaniment signal, prior to mixing them with the mixing means, when it is determined by the volume proportion determination means that the sound volumes of the play signal and accompaniment signal are not in the predetermined proportion.

The described musical accompaniment system additionally includes a request responding means for effecting the sound volume adjustment by the volume adjustment means only when there is a balance adjustment request and such that the balance adjustment is not repeated once the balance adjustment is completed. Accordingly, the automatic volume adjustment is prevented from spoiling intended rise and fall of musical intonations and making the performance monotonous.

Further, the present invention also provides an electric stringed instrument including:

pickup means for detecting the vibrations of strings as an analog signal;

accompaniment data provision means for providing an accompaniment pattern as a digital signal;

digital to analog conversion means for converting the digital signal provided by the accompaniment data provision means into an analog signal;

mixing means for mixing the analog signal detected by the pickup means and the analog signal obtained at the digital to analog conversion means;

amplifier means for amplifying the analog signals before or after they are mixed; and a speaker for emitting sound according to the mixed and amplified signal.

The described electric stringed instrument further includes:

volume proportion determination means for determining whether or not the sound volumes of the analog signal detected by the pickup means and digital signal provided by the accompaniment data provision means are in a predetermined proportion; and volume adjustment means for relatively adjusting the sound volume of the analog signal detected by the pickup means and the digital signal provided by the accompaniment data provision means, prior to mixing them with the mixing means, when it is determined by the volume proportion determination means that the sound volumes of the analog signal and digital signal are not in a predetermined proportion.

In this way, the sound volumes contained in the analog signal and digital signal, respectively obtained at the pickup means and accompaniment data provision means, are balanced to a predetermined proportion. Moreover, since the pickup means detects the vibrations of the strings as an analog signal, affluent timbre unique to electric guitars and other stringed instruments can be expressed in the generated sound. Further, by providing the accompaniment data provision means, digital to analog conversion means, mixing means, amplifier means and speakers integrally in the electric stringed instrument, the player need not undergo the laborious process of connecting and adjusting a rhythm box and other equipment in order to simulate band-play.

The described electric stringed instrument further includes:

voltage adjustment means for extracting a portion of the analog signal detected by the pickup means and adjusting the voltage level of the extracted portion of the analog signal to a predetermined range; and analog to digital conversion means for converting the analog signal having its voltage adjusted by the voltage adjustment means into a digital signal, wherein the volume proportion determination means determines the sound volume of the analog signal according to the digital signal obtained at the analog to digital conversion means. Thus, since the analog signal is previously converted into a digital signal, the volume proportion determination is accurate and expedited.

The electric stringed instrument of the present invention is constructed such that an operation amplifier having a variable amplification factor is provided between the pickup means and mixing means; and the volume adjustment means adjusts the amplification factor of the operation amplifier, thereby adjusting the balance between the sound volume of the analog signal obtained at the pickup means and the sound volume of the digital signal obtained from the accompaniment data provision means. Thus, since the analog signal obtained at the pickup means is amplified by a predetermined amplification factor at the operation amplifier before it is mixed with the digital signal, the volume adjustment later effected is facilitated.

The electric stringed instrument is also constructed such that the volume adjustment means adjusts the sound volume of the digital signal outputted from the accompaniment data provision means prior to sending the digital signal to the digital to analog conversion means, thereby adjusting the balance between the sound volumes of the analog signal obtained at the pickup means and the digital signal obtained from the accompaniment data provision means. Thus, since the digital signal outputted from the accompaniment data provision means has its sound volume adjusted before it is mixed, the sound volume adjustment can be easily performed.

The electric stringed instrument according to the invention further includes request responding means for effecting the sound volume adjustment by the volume adjustment means only when there is a balance adjustment request and such that the balance adjustment is not repeated once the balance adjustment is completed. Since the volume adjustment is not repeated during play, an intended rise and fall of musical intonation is not spoiled.

DETAILED DESCRIPTION OF THE PREFERRED EMBODIMENTS

Embodiment 1

Figure 1:
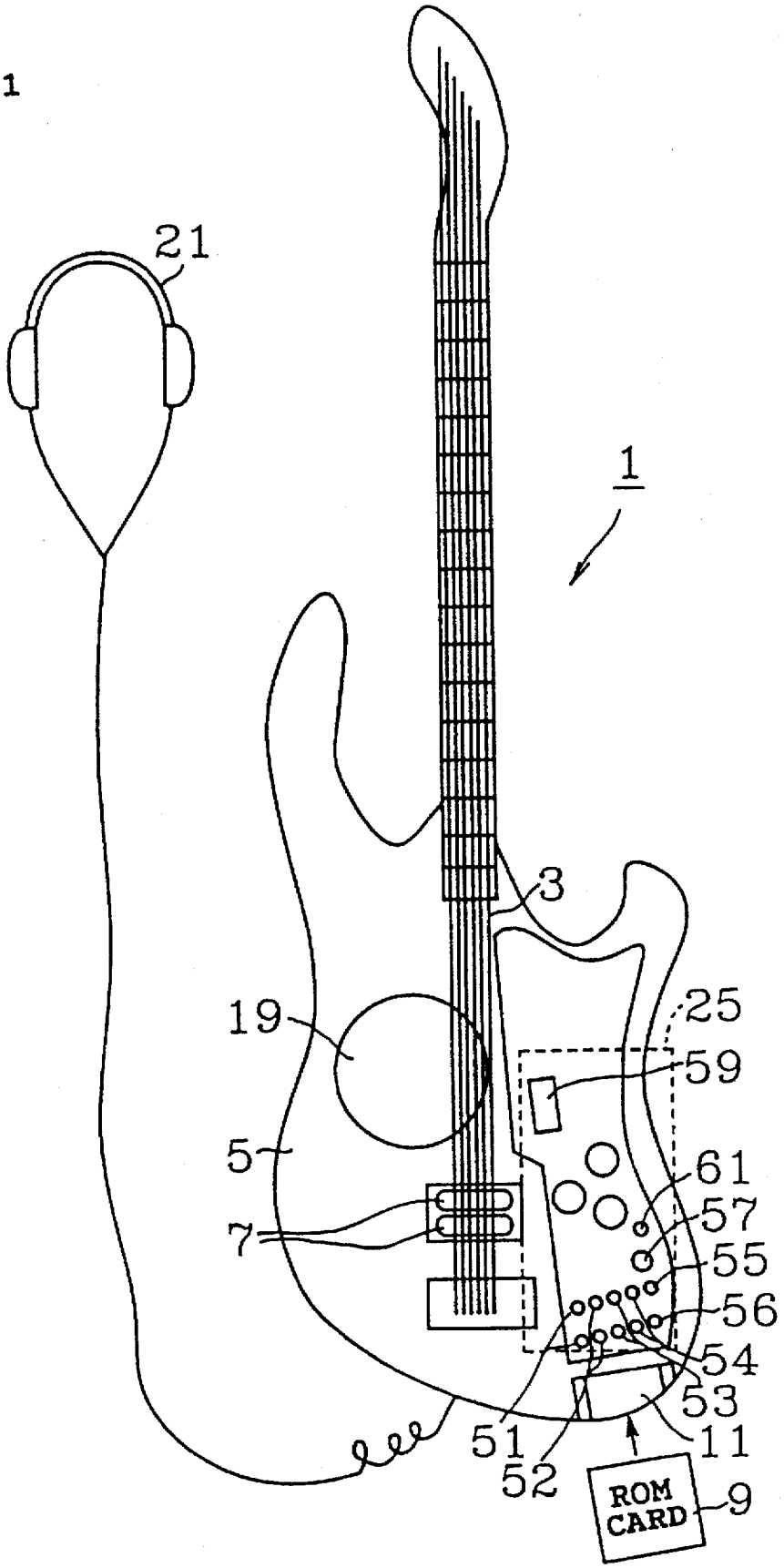
FIG. 1 is an elevational view showing an electric guitar of a first embodiment according to the invention.
Figure 2:
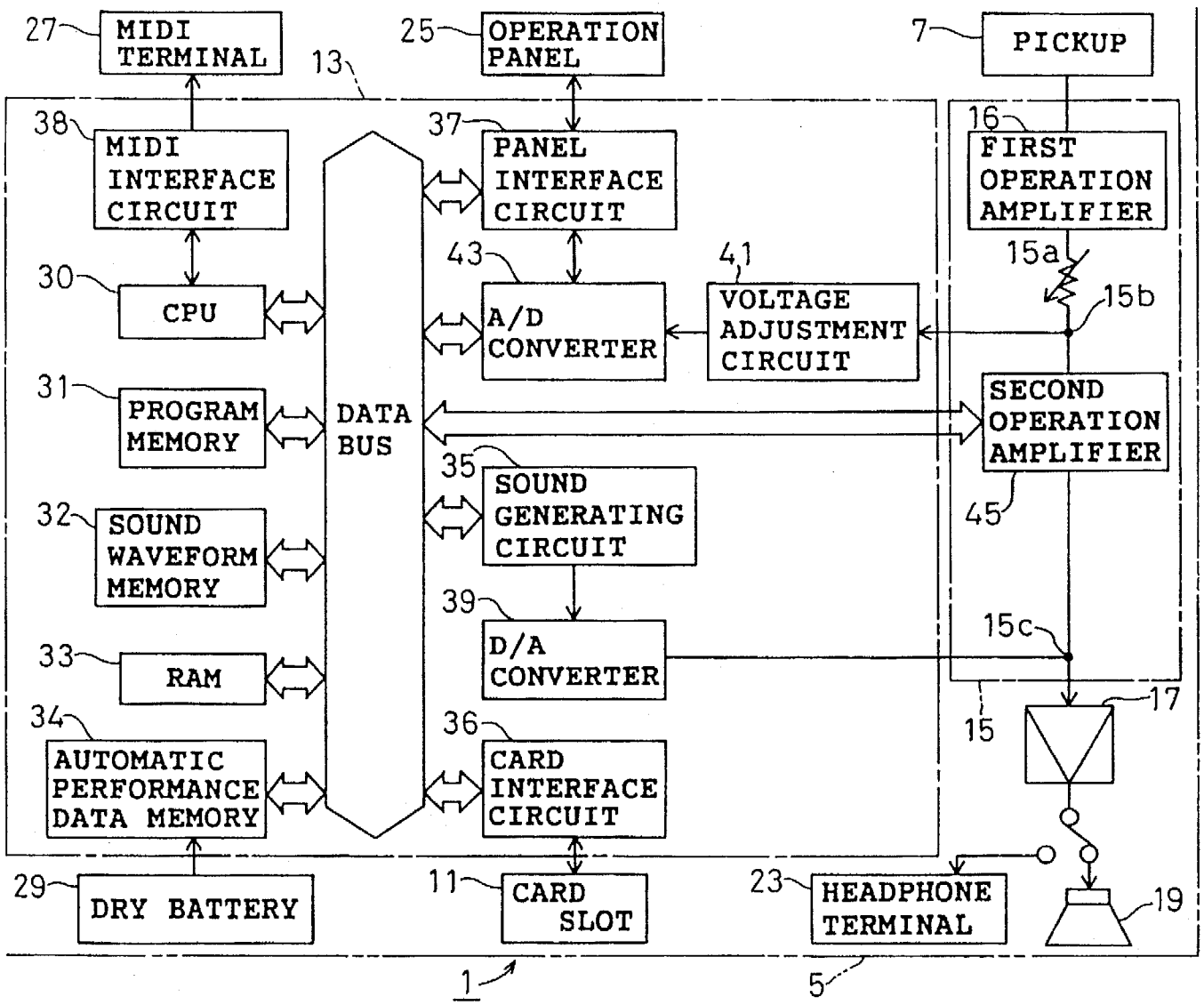
FIG. 2 is a block diagram showing the circuitry of the electric guitar of the first embodiment.

As shown in FIGS. 1 and 2, an electronic guitar 1 has a body 5 with iron strings 3 stretched thereon and pickups 7 for detecting the vibrations of the strings 3 as analog information. A card slot 11 is provided in the body 5 to receive a ROM card 9 storing digitized accompaniment patterns. The body 5 also has an electronic sound source circuit 13 controlled by a CPU 30. Signals outputted from the electronic sound source circuit 13 and pickups 7 are mixed by a mixing unit 15, amplified by an amplifier circuit 17, and outputted as sound from speakers 19. The body 5 also has a headphone terminal 23 to be connect with a headphone 21 which is alternatively used in place of the speakers 19. The body 5 further includes a MIDI terminal 27, dry battery 29 power supply, and an operation panel 25 for entering desired performance conditions into the electronic sound source circuit 13.

There are pickups 7 for each of the strings 3, that detect changes in a magnetic field caused by vibrations of the strings 3, and output the changes as analog signals.

The electronic sound source circuit 13 includes a CPU 30, program memory 31, sound waveform memory 32, RAM 33, automatic performance data memory 34, sound generating circuit 35, card interface circuit 36, panel interface circuit 37, MIDI interface circuit 38 and D/A converter 39. The electronic sound source circuit 13 also includes a voltage adjustment circuit 41 which adjusts a portion of the signals outputted from the pickups 7 to the range from 0–5 volts. The electronic sound source circuit 13 further includes an A/D converter 43 for converting the analog signals outputted from the voltage adjustment circuit 41 to digital signals.

The program memory 31 stores control process programs for performing musical accompaniment. The sound waveform memory 32 stores a variety of sound waveforms of drums, bass, and other instruments necessary for musical accompaniment. The RAM 33 serves for temporarily holding data during various calculations. The automatic performance data memory 34 is a ROM storing various rhythm patterns. The sound generating circuit 35 includes a plurality of channels for creating a plurality of notes at the same time, and outputs digital sound signals according to the sound waveform data read out from the sound waveform memory 32 and the accompaniment data read out from the automatic performance data memory 34 and card interface circuit 36. The card interface circuit 36 is connected to the card slot 11 to read data from the ROM card 9. The panel interface circuit 37 is connected to the operation panel 25 to receive instructions from a player. The MIDI interface circuit 38 is connected to the MIDI terminal 27 to output the data read out from the automatic performance data memory 34 and ROM card 9 to external MIDI equipment, and to receive performance data from the external MIDI equipment. The performance data inputted from the external MIDI equipment can be processed as accompaniment data in the same manner as is the data from the automatic performance data memory 34 and ROM card 9. The D/A converter 39 serves for converting the digital signals outputted from the sound generating circuit 35 to analog signals.

The mixing unit 15 has a volume adjustment circuit 15*a* formed of a variable resistor for adjusting the level of the analog signals detected at the pickups 7. Between the volume adjustment circuit 15*a* and the pickups 7 there is provided a first operation amplifier 16 for adjusting the impedance within the circuit. The mixing unit 15 also includes a branch point 15*b* below the volume adjustment circuit 15*a* for branching the stream of signals toward the aforementioned voltage adjustment circuit 41. Between the branch point 15*b* and a mixing point 15*c* there is provided a second operation amplifier 45 the amplification factor of which is variably determined by the CPU 30.

Figure 3:
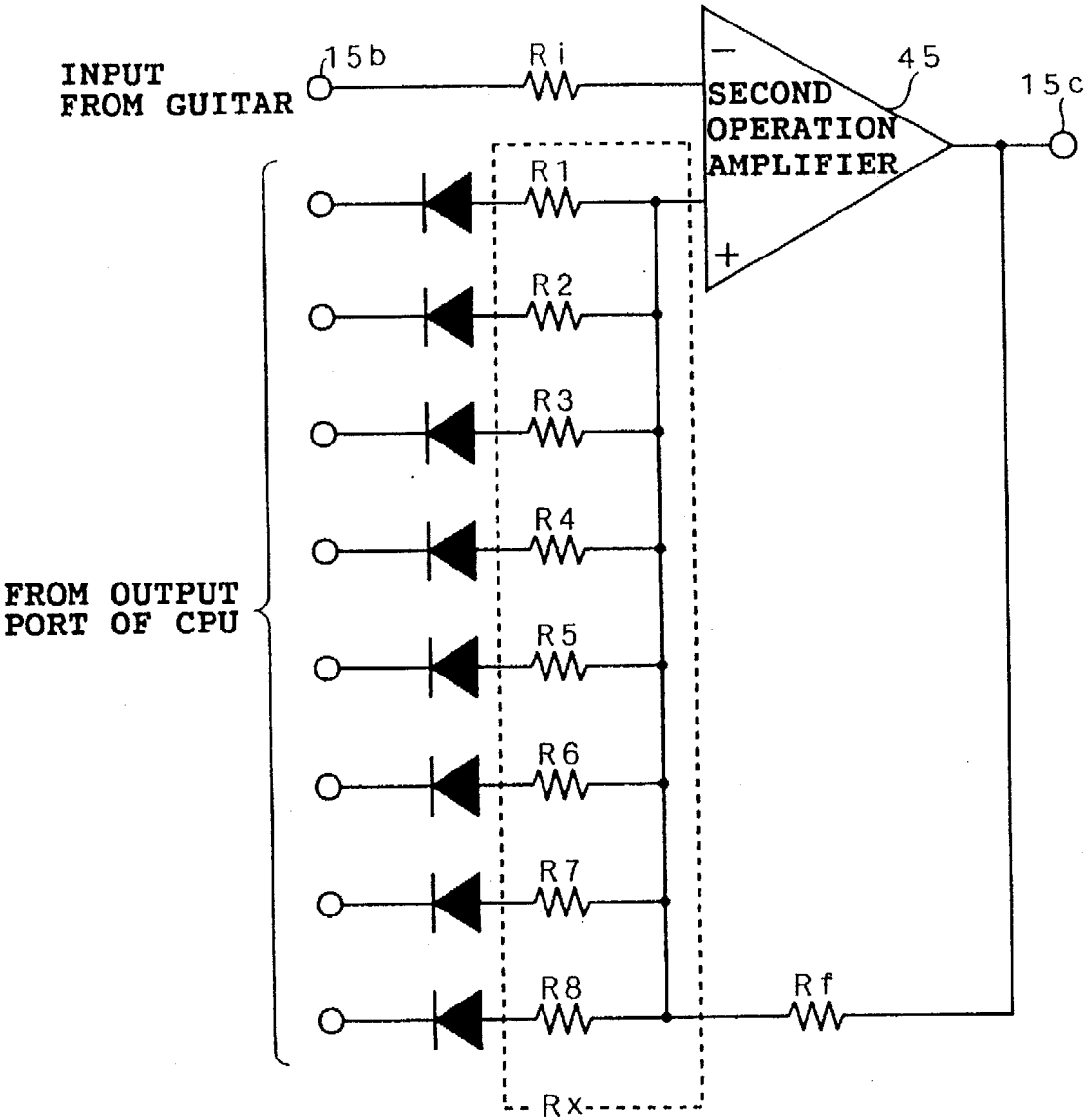
FIG. 3 is a block diagram showing a second operation amplifier of the first embodiment.

The structure of the second operation amplifier 45 is shown in FIG. 3. The CPU 30 selects an amplification factor from eight degrees of amplification factors, and then selects a corresponding one of the resistors Rx (x=1–8), as shown in FIG. 3. The amplification factor is determined as defined according to the relation between the selected resistor Rx and another resistor Rf by the equation:

$$(\textit{Amplification factor})=1+Rf/Rx$$

When, for example, the resistors are defined by the equations R1=Rf, R2=R1/3, R3=R1/7, R4=R1/15, R5=R1/31, R6=R1/63, R7=R1/127, R8=R1/255, an amplification factor for the second operation amplifier 45 is selected from among 2, 4, 8, 16, 32, 64, 128 and 256 times the amplitude by selecting one of the ports of resistors R1–8. A low level signal is then outputted to the selected port for amplification. Further, by using a plurality of Rx resistors in parallel, a more minute adjustment of the amplification factor can be attained.

The operation panel 25 is provided with a rhythm volume switch 51 for adjusting the sound volume of the accompaniment created by the electronic sound source 13, tempo switch 52 for adjusting the tempo of the accompaniment, transpose switch 53 for transposing the accompaniment, select switch 54 for selecting an accompaniment pattern, part mute switch 55 for muting the sound of a given part, data selection switch 56 for selecting either the accompaniment data from the automatic performance data memory 34 or the accompaniment data from the ROM card 9, guitar volume switch 57 for adjusting the volume of the guitar sound, indicator 59, and automatic balancing switch 61 for instructing the CPU to execute the process of automatically balancing volumes, which will be later explained in detail. Additional switches may be provided giving a player a finer control of the system. Each of the rhythm volume switch 51, tempo switch 52, transpose switch 53 and select switch 54 consist of a pair of "up" and "down" buttons, through which the player can adjust the volume, tempo and other musical conditions as desired. Each of the part mute switch 55, data selection switch 56 and the automatic balancing switch 61 consists of a button which is repeatedly pressed to obtain a desired condition. The indicator 59 displays a two-digit value including two sets of LED, or light emitting diodes, made of seven segments, thereby indicating the selected musical condition according to the operation on the switches 51–56.

Figure 4:
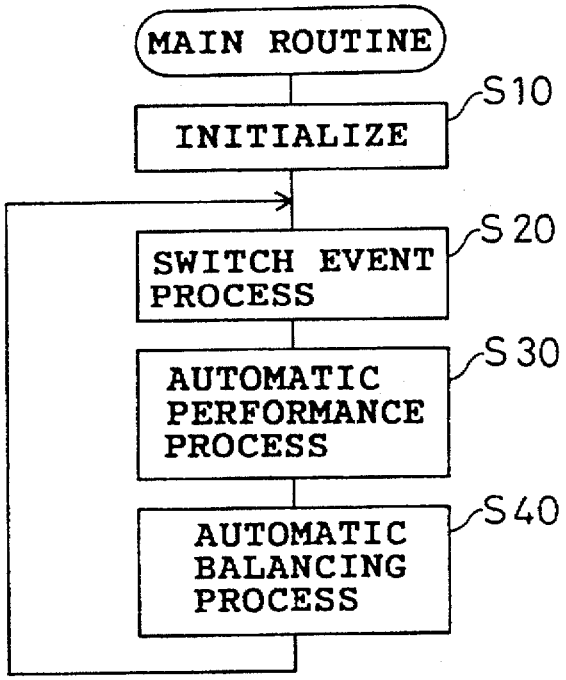
FIG. 4 is a flowchart showing the main routine of the process steps of the first and second embodiments.

The process effected at the CPU 30, the main routine of which is shown in FIG. 4, follows the steps described hereinafter.

First, when the power is turned on, the CPU 30 effects an initialization process, at step 10, thereby clearing the storage of the RAM 33 and initializing the sound conditions, such as rhythm volume, tempo, transposition, selected rhythm pattern, and muted part. In the initialization, the current guitar volume designated by the player is assumed as a reference value, to which the rhythm volume is balanced.

Figure 5:
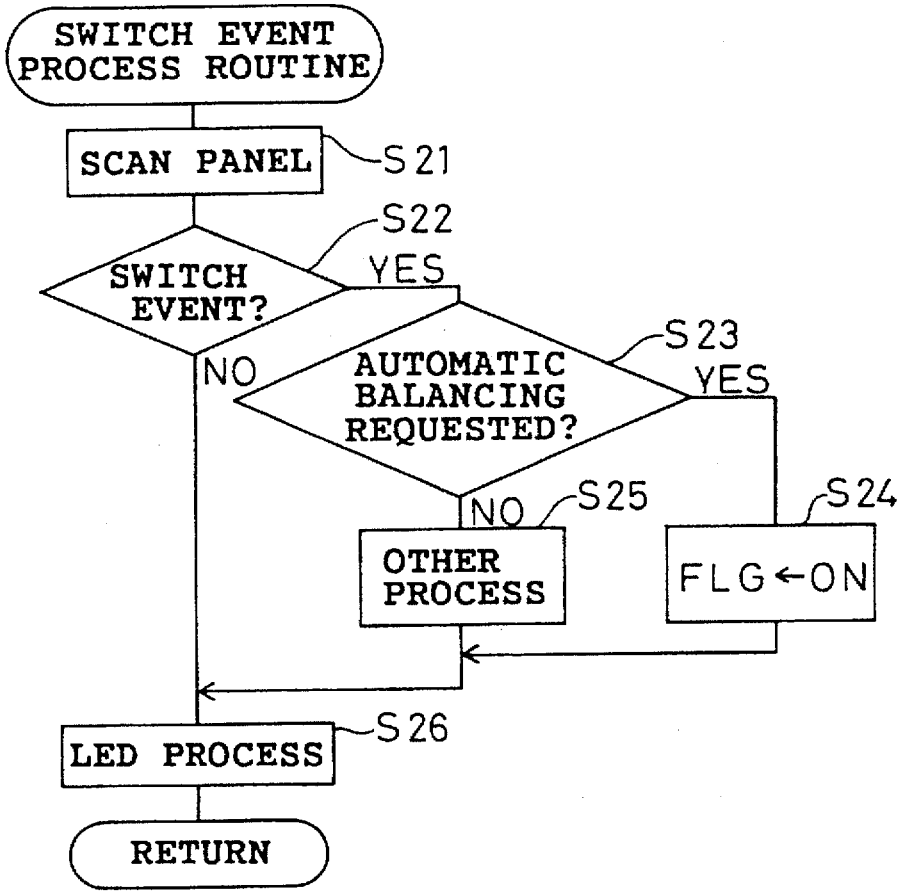
FIG. 5 is a flowchart showing the switch event process of the first and second embodiments.

Subsequently, a switch event process is performed, at step 20, wherein the switches 51–58 of the operation panel 25 are scanned for an operation of the switches by a player and the sound conditions are changed accordingly. In addition, the sound conditions determined through the operated switch (es) is indicated by the two-digit figure at the indicator 59. The player, viewing the figure indicated at the indicator 59, presses the switches to obtain the desired rhythm pattern, rhythm volume and other sound conditions. Specifically, the switch event process takes the following steps, as shown in FIG. 5.

First, when there is a switch event, it is determined whether or not that switch event was an activation of the automatic balancing switch 61, steps 21–23. When the determination is "YES" at the step 23, a flag FLG, indicating a request for automatic volume balancing, is set at "ON", at step 24. On the other hand, when the switch event was an activation of a switch(es) other than the automatic balancing switch 61, the process corresponding to the instruction on the activated switch(es), such as rhythm pattern selection, is performed, step 25. Consequently, the LED process is performed, step 26, to indicate the musical conditions determined by the switch event process on the indicator 59.

When the player finishes setting the sound conditions, the process goes to an automatic performance process, at step 30. The automatic performance process in the instant embodiment is the same as the process effected in conventional rhythm boxes and electronic musical instruments, and performs the following processes. First, according to the selected rhythm pattern, an accompaniment pattern data is read out from either the automatic performance data memory 34 or ROM card 9. A sound waveform is read out from the sound waveform memory 32 according to note-on data in the accompaniment data. Then, sound data for each of the notes is allocated to an unoccupied channel of the sound generating circuit 35. The allocated sound data includes envelope curves and the volume of rhythm pattern, tempo, transposition and muted part entered during the switch event process. The sound data also includes volume levels determined by note-on data.

On the other hand, when a note-off data is read out, the volume level of the channel corresponding to the note-off data is set at zero.

Thus, the sound generating circuit 35 outputs a digital signal based on the sound data determined from each of the note-on data. The outputted digital signals, the waveform of which are specific to each musical instrument such as a drum, are converted into an analog signal by the D/A converter 39, amplified by the amplifier circuit 17 and outputted as sound from the speakers 19. The output of a digital signal is terminated when a corresponding note-off data is read out. Thus, the guitar 1 of the instant embodiment functions as a rhythm box.

Without the afore-described process by the CPU 30 the guitar 1 functions as an electric guitar. Specifically, the vibrations of the strings 3 are detected by the pickups 7 and are sent to the mixing unit 15 as analog signals and mixed with an analog accompaniment pattern signal. The sound volume of the guitar 1 as an electric guitar is adjusted, as the player desires, at the volume adjustment circuit 15*a* prior to mixing the signals. The guitar 1 can also be played without using an accompaniment pattern, thereby functioning as a simple electric guitar.

Figure 6:
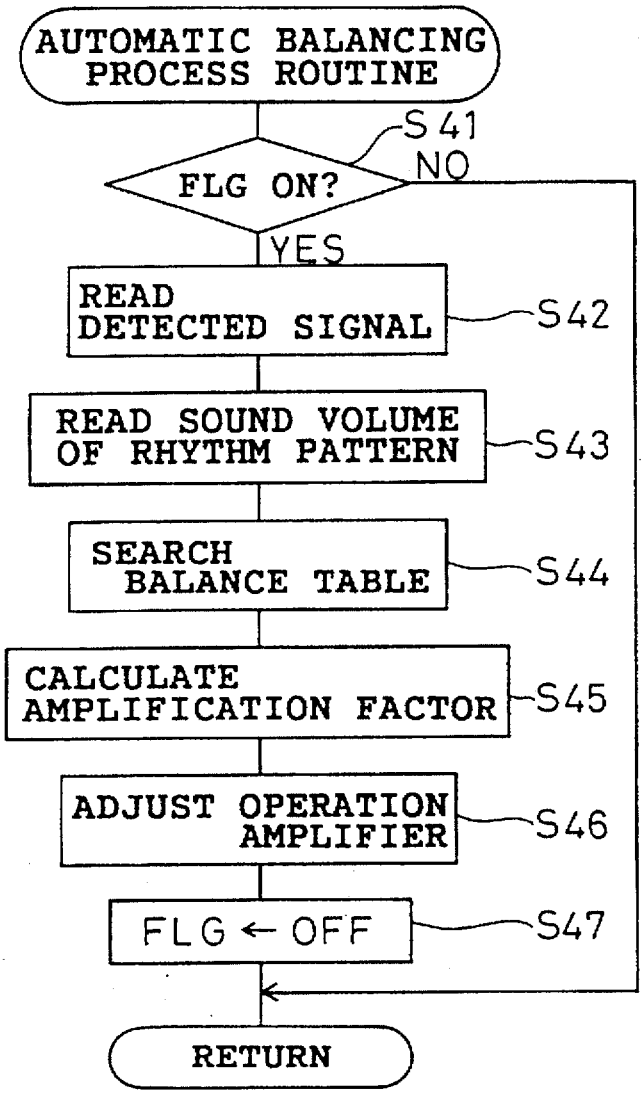
FIG. 6 is a flowchart of the automatic balancing process of the first embodiment.

If the flag FLG indicating a request for automatic volume balancing has been set to "ON" in the switch event process, the automatic balancing process is subsequently performed, at step 40, as shown in FIG. 6.

At the first step 41 of the automatic balancing process, it is determined whether the request flag FLG is set at "ON". When the determination is "NO", the process goes back to the main routine. On the other hand, if the determination is "YES" at the step 41, the detected signal caused by guitar play obtained from the branch point 15*b* through the voltage adjustment circuit 41 and A/D converter 43 is read out, at step 42. Also, the rhythm volume determined in the switch event process is read out, at step 43. Next, a balance table stored within the data area of the program memory 31 is referred to, at step 44. The balance table specifies predetermined appropriate ratio of guitar volumes relative to rhythm volumes. Then, the appropriate ratio according to the balance table is divided by the inputted signal of guitar play, thereby obtaining an amplification factor according to the calculation of:

(amplification factor)=(table ratio)/(inputted value)

Subsequently, at least one resistor among the resistors R1–R8 is activated such that the amplification factor at the second operation amplifier 45 is adjusted to the calculated amplification factor, at step 46. When the volume balance has been thus adjusted, the automatic balancing request flag FLG is set at "OFF", at step 47, because if the flag FLG is kept set at "ON", intended intonations in the guitar play is spoiled and the performance becomes monotonous.

The processes from step 20 to step 40 are repeated until the power is turned off.

The table referred to at the step 44 may have values that vary with respect to the rhythm pattern, and the values may be set during a system entry mode or other appropriate modes. Between the diode of the second operation amplifier 45 and the output port of the CPU 30 there is preferably provided either a HEX buffer or HEX invertor for protecting the output port. Further, for reliability in detecting the inputted signals, a peak hold circuit is preferably provided before the A/D converter 43 to maintain a peak of each inputted signal for a specified time period.

Embodiment 2

Figure 7:
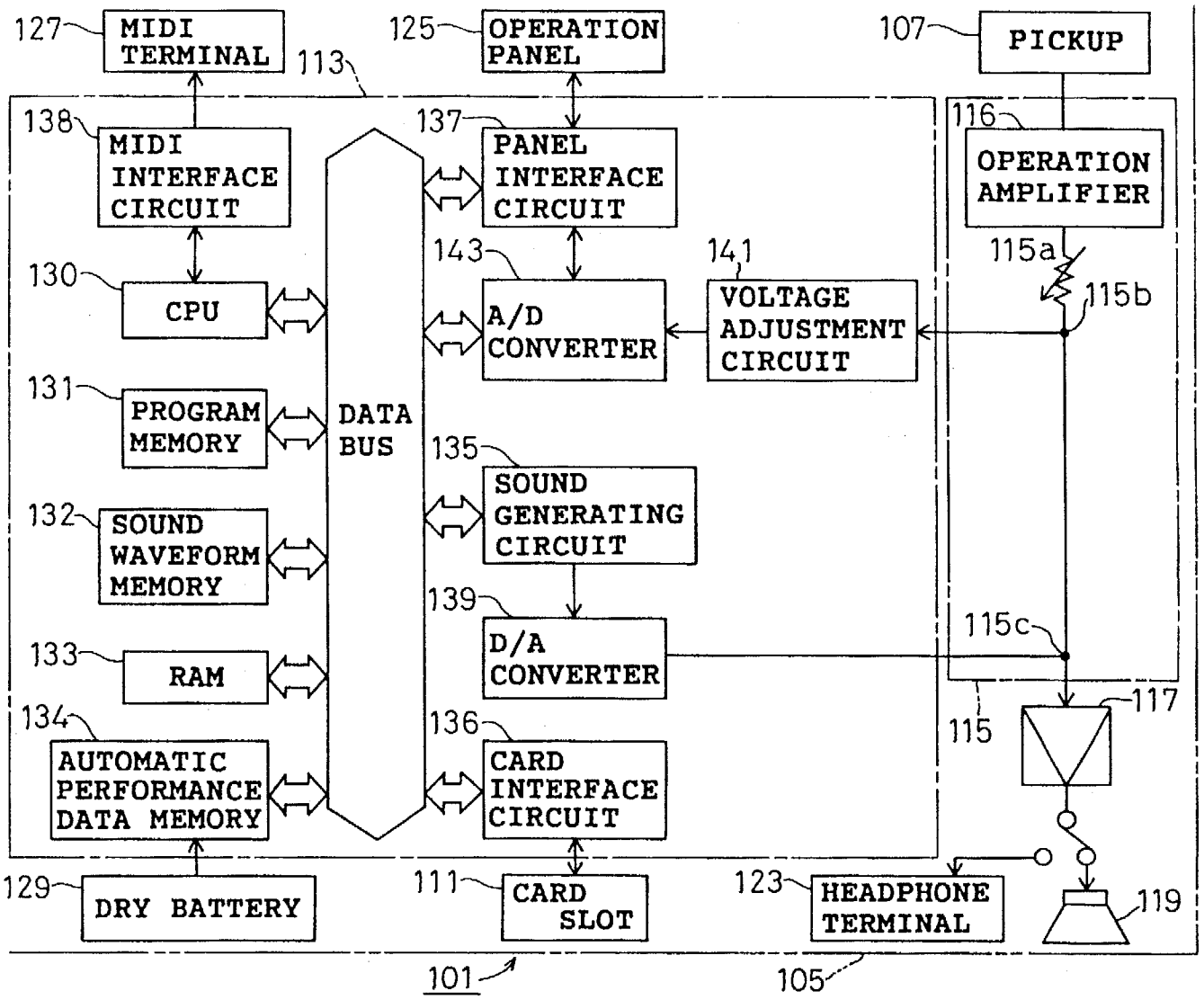
FIG. 7 is a block diagram showing the circuitry of the electric guitar of the second embodiment.

An electric guitar of the second embodiment has a hardware structure similar to that of the first embodiment, but without an operation amplifier corresponding to the second operation amplifier 45 of the first embodiment, as shown in FIG. 7.

Figure 8:
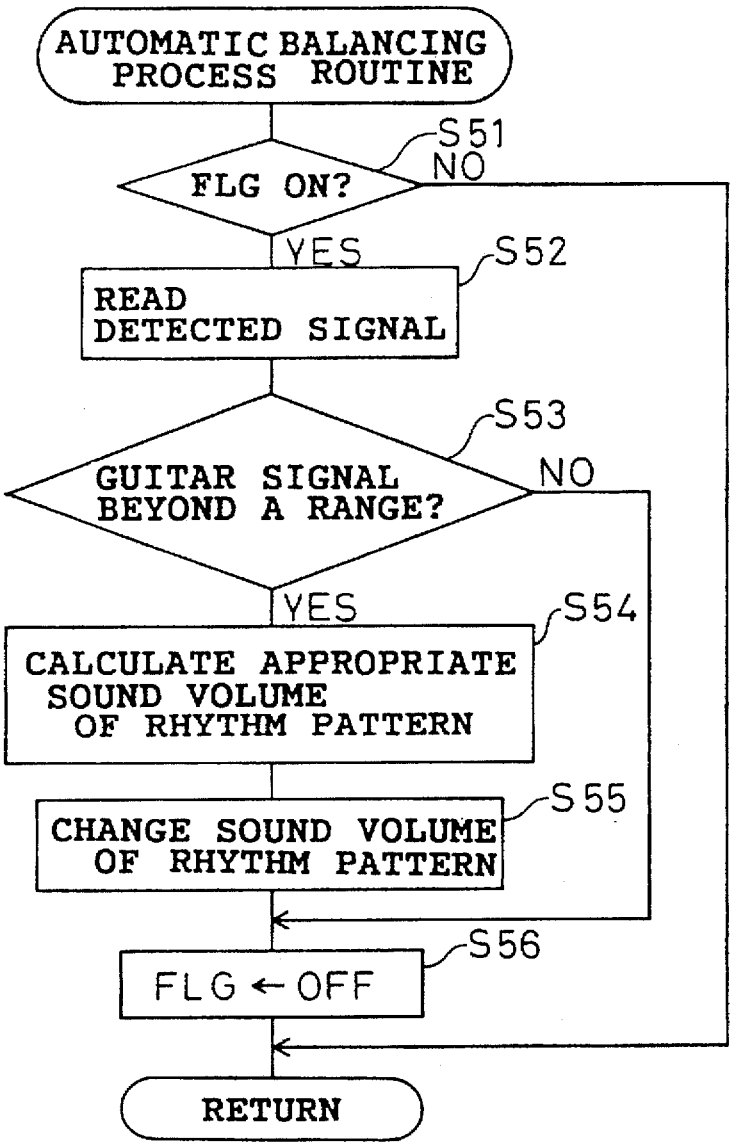
FIG. 8 is a flowchart showing the automatic balancing process of the second embodiment.

The electric guitar of the second embodiment is characterised by its automatic balancing process as shown in FIG. 8.

The automatic balancing process of the second embodiment is similar to that of the first embodiment so far as the automatic balancing request flag FLG is first checked, step 51, and, if the flag FLG is set at "ON", a detected signal of guitar play is read through an A/D converter 143, at step 52.

Subsequently, it is determined whether the signal read at the step 52 is beyond a predetermined volume range, at step 53. When the determination is "YES", an adjustment value of the rhythm volume is obtained according to the difference, at step 54, and the adjustment value is added to or subtracted from the rhythm volume initially determined, thereby calculating a correct value for the rhythm volume. The rhythm volume determined within the RAM 133 is then changed to the correct value, at step 55, and the automatic balancing request flag FLG is set at "OFF", at step 56, thereby finishing the instant process. The flag FLG is set at "OFF" for the same reason as in the first embodiment. On the other hand, if the determination at the step 53 is "NO", the process at step 56 is effected, without changing the volume level of the rhythm, and the automatic balancing request flag FLG is set at "off", thereby finishing the instant process. Thus, the value determined by the initialization process is regarded as the reference value.

Simply by entering a request for automatic balancing, the electric guitars of the first and second embodiments automatically attain a balance in sound volume between the guitar play and the accompaniment rhythm pattern, without requiring laborious manual adjustment. Since the volume is automatically balanced only once and only when requested through the automatic balancing switch 61, the intended rise and fall of sound is not spoiled. When the automatic volume balancing is unwanted, the rhythm volume switch 51 or 151 and guitar volume switch 57 or 157 can be activated to change the volumes as desired.

The electric guitars of both embodiments provide various advantages. First, the player can enjoy band or full orchestra-play without preparing and connecting numerous pieces of equipment such as a rhythm box, amplifier, mixer and speaker. Unlike synthesizers and other totally electronic musical instruments, the electric guitars of the embodiments can be used as a common electric guitar with which unique performances, such as vibrato, choking and harmonics, can be created. In addition, by using a dry battery as the power source, the guitars of the embodiments can be played anywhere and any time.

This invention has been described above with reference to the preferred embodiments as shown in the drawings. Modifications and alterations may become apparent to one who skilled in the art upon reading and understanding the specification. Despite the use of the embodiments for illustration purposes, the invention is intended to include all such modifications and alterations within the scope and spirit of the appended claims.

In this spirit, it should also be noted that in the embodiments, the present invention is applied to an electric guitar. However, the present invention can be applied to an electric bass and various other electric stringed instruments. Further, power feeder cables may be adopted to use a domestic power source or an automobile battery as the power source. Alternatively, the electric guitar may exclusively use a domestic power source. In the embodiments, the automatic balancing is effected only once in response to a single automatic balancing request. However, the automatic balancing may be effected repeatedly for a predetermined time period after the request. In this case, termination of the automatic balancing may be indicated on the LED or by a buzzer.

Further, once a request for automatic balancing is made, the automatic balancing may be continuously effected until a request is made to discontinue the automatic balancing. In the second embodiment, it is the volume of the rhythm pattern that is automatically balanced. Therefore, even if the automatic balancing is continuously executed, the intonations in guitar play are not spoiled. In this way, the player can enjoy the rise and fall of rhythm intonations created by his guitar play.

Moreover, although in the described embodiments signals of guitar-play and a rhythm pattern are first mixed and then amplified, they may be first amplified and then mixed.

Further, the present invention may be applied to a karaoke singing system for balancing the volumes of a singer's voice and an accompaniment. The object is attained by adjusting the voltage of the inputted singer's voice signal and performing A/D conversion in a manner similar to the embodiments described above.

Wherefore, what is claimed is:

1. An electric stringed instrument having at least a normal electric stringed instrument playing mode and an automated accompaniment mode for outputting accompaniment sound to said instrument, said electric stringed instrument comprising:

a plurality of metallic strings supported by said instrument;

pickup means located adjacent said plurality of strings for detecting vibrations of said plurality of strings on said instrument and for generating a corresponding analog play signal;

accompaniment provision means for providing, in said automated accompaniment mode, separate prerecorded information as a digital accompaniment signal for accompanying said play signal;

digital to analog conversion means, coupled to said accompaniment provision means, for converting said digital accompaniment signal into an analog accompaniment signal;

mixing means, coupled to said pickup means and said accompaniment provision means; for mixing said play signal and said analog accompaniment signal;

amplifier means, coupled to said mixing means, for amplifying said play signal and said analog accompaniment signal after said play signal and said analog accompaniment signal are mixed;

a speaker, coupled to said amplifier means, for emitting sound according to said mixed and amplified signals;

volume proportion determination means, coupled to said pickup means, for determining whether the volume level of said play signal and said digital accompaniment signal are at the same volume level;

volume adjustment means, coupled said volume proportion determination and said pickup means, for adjusting the volume levels of at least one of said play signal and said digital accompaniment signal, prior to mixing them with said mixing means, when it is determined by said volume proportion determination means that the volume levels of said play signal and said digital accompaniment signal are at different volume levels, to adjust said volume levels of said play signal and said analog accompaniment signal to the same volume level; and request responding means for effecting the volume level adjustment by said volume adjustment means only when there is a balance adjustment request and such that the balance adjustment is not repeated once the balance adjustment is completed.

2. An electric stringed instrument according to claim 1, further comprising:

voltage adjustment means, coupling said pickup means to said volume proportion determination means, for extracting a portion of said play signal and adjusting a voltage level of said extracted portion to a predetermined range; and analog to digital conversion means for converting said extracted portion having its voltage adjusted into a digital play signal;

wherein said volume proportion determination means determines whether volume levels of said digital play signal and said digital accompaniment signal are at said same level.

3. An electric stringed instrument according to claim 1, comprising an operation amplifier having a variable amplification rate, provided between said pickup means and said mixing means for amplifying the volume level of one of said play signal and said digital accompaniment signal;

wherein said volume adjustment means adjusts the amplification rate of said operation amplifier, thereby relatively adjusting the volume level of said play signal and said accompaniment signal.

4. An electric stringed instrument according to claim 1, wherein said volume adjustment means includes means to adjust the volume level of said digital accompaniment signal prior to sending said digital accompaniment signal to said digital to analog conversion means.

5. A method of adjusting sound balance of an electric stringed instrument having at least a normal electric stringed instrument playing mode and an automated accompaniment mode for outputting accompaniment sound to said instrument, said method comprising the steps of:

supporting a plurality of metallic strings on said instrument;

locating pickup means adjacent said plurality of strings for detecting vibrations of said plurality of strings on said instrument and for generating a corresponding analog play signal;

detecting vibrations of strings on said instrument via pickup means;

emitting an analog play signal corresponding to said vibrations;

providing accompaniment provision means for providing, in said automated accompaniment mode, separate prerecorded information as a digital accompaniment signal for accompanying said play signal;

converting said digital accompaniment signal into an analog accompaniment signal via a digital to analog conversion means;

mixing said analog play signal and said analog accompaniment signal via a mixing means;

amplifying said analog play signal and said analog accompaniment signal one of before and after they are mixed, via amplifier means;

emitting sound according to said mixed and amplified signals via a speaker;

determining whether volume levels of said analog play signal and said digital accompaniment signal are in a predetermined proportion via a volume proportion determination means coupling said pickup means to said volume proportion determination means;

relatively adjusting the volume levels of said analog play signal and said digital accompaniment signal via volume adjustment means prior to mixing them with said mixing means, when it is determined by said volume proportion determination means that the volume levels of said analog play signal and said digital accompaniment signal are not at said predetermined proportion, thereby to place said volume levels of said analog play signal and said analog accompaniment signal in said proportion; and effecting the volume level adjustment by said volume adjustment means, via a request responding means, only when there is a balance adjustment request and such that the balance adjustment is not repeated once the balance adjustment is completed.

6. A method according to claim 5 comprising the steps of:

extracting a portion of said analog play signal via a voltage adjustment means;

adjusting a voltage level of said extracted portion to a predetermined range;

converting said extracted portion, having its voltage adjusted, into a digital play signal via an analog to digital conversion means; and determining whether the volume levels of said digital play signal and said digital accompaniment signal are at said predetermined proportion via said volume proportion determination means.

7. A method according to claim 5 comprising the steps of:

providing an operation amplifier, having a variable amplification rate, between said pickup means and said mixing means, for amplifying the volume level of one of said analog play signal and said digital accompaniment signal; and adjusting the amplification rate of said operation amplifier via said volume adjustment means, thereby relatively adjusting the volume level of said analog play signal and said accompaniment signal.

8. A method according to claim 5 comprising the step of:

adjusting the volume level of said digital accompaniment signal, via said volume adjustment means, prior to sending said digital accompaniment signal to said digital to analog conversion means.

* * * * *